US005605446A

United States Patent [19]

Handzel et al.

[11] Patent Number: 5,605,446

[45] Date of Patent: Feb. 25, 1997

[54] HIGH VISCOSITY MATERIAL PUMP HAVING VALVED PRIMING PISTON

[75] Inventors: James J. Handzel, Minnetonka; Bradley K. Voigt, Maple Lake, both of Minn.

[73] Assignee: Graco Inc., Minneapolis, Minn.

[21] Appl. No.: 324,921

[22] Filed: Oct. 18, 1994

[51] Int. Cl.[6] ..... F04B 7/00

[52] U.S. Cl. ..... 417/262; 417/489; 417/513

[58] Field of Search ..... 417/259, 262, 417/489, 513, 515, 520

[56] References Cited

U.S. PATENT DOCUMENTS

| | | | |
|---|---|---|---|
| 693,920 | 2/1902 | Sterrett | 417/513 |
| 2,615,401 | 10/1952 | Mock . | |
| 2,723,625 | 11/1955 | Nichols . | |
| 3,160,105 | 12/1964 | Sherman et al. | 417/262 |
| 4,014,629 | 3/1977 | Elsworth . | |
| 4,591,315 | 5/1986 | Fekete . | |
| 4,591,316 | 5/1986 | Fekete . | |
| 4,708,597 | 11/1987 | Fekete . | |
| 4,740,141 | 4/1988 | Fekete . | |
| 4,875,833 | 10/1989 | Canaud et al. | 417/489 |
| 5,067,882 | 11/1991 | De Vries et al. | 417/520 |
| 5,147,188 | 9/1992 | Schaefer | 417/513 |

*Primary Examiner*—Timothy Thorpe
*Assistant Examiner*—Roland G. McAndrews, Jr.
*Attorney, Agent, or Firm*—Douglas B. Farrow

[57] ABSTRACT

A reciprocable liquid pump having a priming cylinder affixed beneath the lower valve housing, and a priming piston rod affixed to the lower end of the pump piston valve assembly. A priming piston and priming valve are affixed to the lower end of the priming piston rod, the priming piston being slidable over a limited range of movement along the priming piston rod and having a central opening with a beveled valve seat. The priming valve forms a conical valve surface which is engageable against the priming piston valve seat to provide a controllable flow path through the center opening of the priming piston.

13 Claims, 3 Drawing Sheets

HIGH VISCOSITY MATERIAL PUMP HAVING VALVED PRIMING PISTON

BACKGROUND OF THE INVENTION

This invention relates to reciprocable piston pumps for pumping liquids; more particularly, the invention relates to a priming piston attachment for a reciprocable pump which is particularly useful for pumping high viscosity materials.

Reciprocable pumps have long been used for pumping liquids of various viscosities where the pump is typically at least partially immersed into a liquid container to withdraw liquid from the container and pump it under pressure via a delivery hose to a remote point. On the piston upstroke, liquid is drawn into an intake valve housing through an intake valve which is typically located at the bottom of the pump. At the same time, liquid is forced out of the main pumping cylinder by the upward movement of the piston. On the downstroke, the intake valve closes on a seat and a piston valve opens to permit liquid in the intake valve housing to flow upwardly into the main pump cylinder above the piston. At the same time, the pump displacement rod is moving down into the main pump cylinder forcing liquid out through the outlet housing.

When high-viscosity liquids are pumped by a reciprocable pump, it frequently becomes necessary to increase the force applied against the liquid in the container to assist in moving the liquid into the pump intake valve housing. Inductor plates or ram plates are frequently used for this purpose, wherein an external force is applied against the liquid surface to develop a positive pressure to force the liquid upwardly into the pump intake valve housing. Another technique which has been used is to add a priming cylinder to the lower end of the pump, beneath the intake valve housing, and to add a priming piston and rod extension to the reciprocable pump rod so that the priming piston can reciprocate into and out of the priming cylinder. Under this circumstance, the priming piston also moves upwardly during the pump upstroke and forces liquid into the priming cylinder and thereafter upwardly into the intake valve housing. During the downstroke the priming piston is pushed completely out of the priming cylinder to open the bottom of the cylinder into contact with the liquid in the container.

In pumping highly viscous materials such as sealants, adhesives and silicones, there is a need to further enhance the flow of liquids into the pump to minimize or avoid pump cavitation. In particular, there is a need to improve the flow of liquid into the priming cylinder during the pump downstroke to enable the priming cylinder to completely fill with liquid for delivery during the pump upstroke.

SUMMARY OF THE INVENTION

The present invention provides a priming piston for use in conjunction with a priming cylinder to permit liquid flow into the priming cylinder during the downstroke of the pump during the interval when the priming piston is moving downwardly through the priming cylinder. The invention comprises a priming piston which is slidably movable about a priming piston rod over a limited distance, the priming piston having a center opening surrounded by a conical seat. A cone-shaped valve is affixed at the bottom of the priming piston rod, projecting beneath the priming piston, so that the cone-shaped valve can engage the conical seat during the upstroke movement of the priming piston rod and can disengage from the conical seat during the downstroke movement of the priming piston rod. This permits liquid to flow through the priming piston during the downstroke movement of the rod and prevents liquid flow through the priming piston during the upstroke movement of the rod.

It is a principal object of the present invention to improve the pumping efficiency of reciprocable pumps, particularly for high-viscosity materials.

It is another object and advantage of the present invention to provide a priming piston having a valve to permit liquid to flow through the priming piston, with minimal restriction, during the downstroke.

It is another object and advantage of the invention to provide a priming piston and valve assembly which is separable during the downstroke to permit liquid flow through the piston and is engaged during the upstroke to force liquid into the priming cylinder.

Other and further objects and advantages of the invention will become apparent from the following specification and claims and with reference to the appended drawings.

DESCRIPTION OF THE PREFERRED EMBODIMENT

Figure 1:
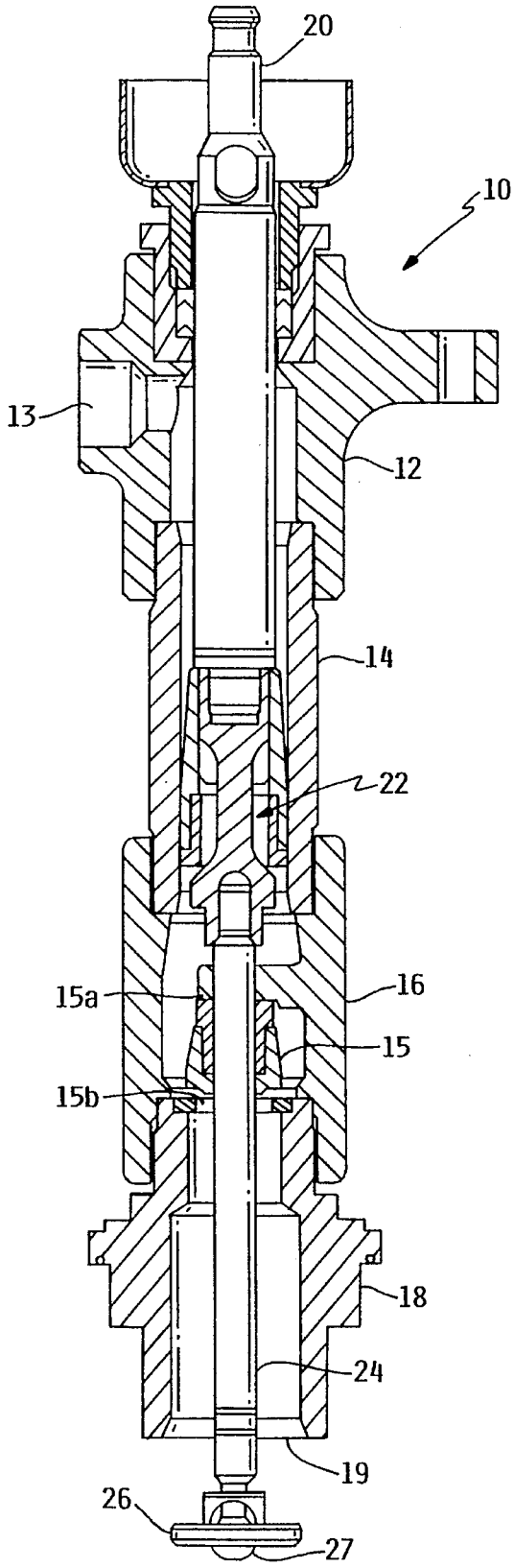
FIG. 1 shows an elevation cross-section view of a reciprocable pump incorporating the present invention.

Referring first to FIG. 1, there is shown an elevation view in cross section of a typical reciprocable pump 10 having the invention attached thereto. The pump 10 has an upper housing 12 which is adaptable for attachment to a suitable liquid container or for attachment to a fixed position relative to a container. A pumping cylinder 14 is threadably attached into the lower end of upper housing 12, and an intake valve housing 16 is threadably attached to the lower end of pumping cylinder 14. A priming cylinder 18 is threadably attached to the lower end of intake valve housing 16, and priming cylinder 18 has a lower opening 19 for receiving the inflow of the particular liquid to be pumped. A piston rod 20 is slidably positioned in upper housing 12, piston rod 20 having an upper end which is adapted for connection to a suitable reciprocable driving source. The lower end of piston rod 20 is attached to a piston valve assembly 22. Piston valve assembly 22 may be of the type disclosed in U.S. Pat. No. 5,147,188, owned by the assignee of the present invention, and incorporated by reference herein. A priming piston rod 24 is attached to the lower end of piston valve assembly 22 and extends downwardly through intake valve housing 16 and priming cylinder 18. A priming piston 26 is slidably movable along the lower portion of priming piston rod 24, and a priming valve 27 is affixed at the bottom of priming piston rod 24. An intake valve 15 is slidably fitted about priming piston rod 24 and is movable between a mechanical stop 15*a* and an intake valve seat 15*b*.

In operation, when the top end of piston rod 20 is connected to a suitable reciprocable driving source, the entire assembly comprising piston rod 20, piston valve assembly 22, priming piston rod 24, priming piston 26 and priming valve 27 all reciprocate together in coincidence with the reciprocable driving motor. During the upstroke liquid is drawn into priming cylinder 18 and intake valve housing 16 and is forced upwardly out of pumping cylinder 14 and upper housing 12, through the pump outlet 13. During the downstroke, intake valve 15 closes against intake seat 15*b*. The liquid in intake valve housing 16 is forced upwardly through piston valve assembly 22 into pumping cylinder 14; and at the same time priming piston 26 is forced downwardly through priming cylinder 18 to a final position which is beneath priming cylinder 18.

Figure 2:
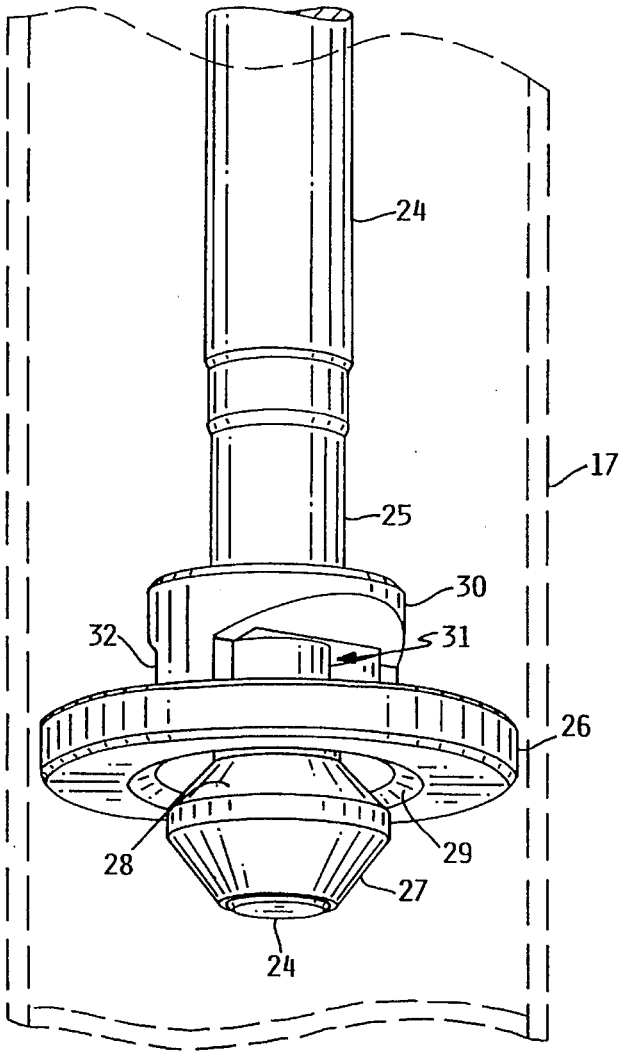
FIG. 2 shows an isometric elevation partial view of the priming piston and valve of the present invention.
Figure 3:
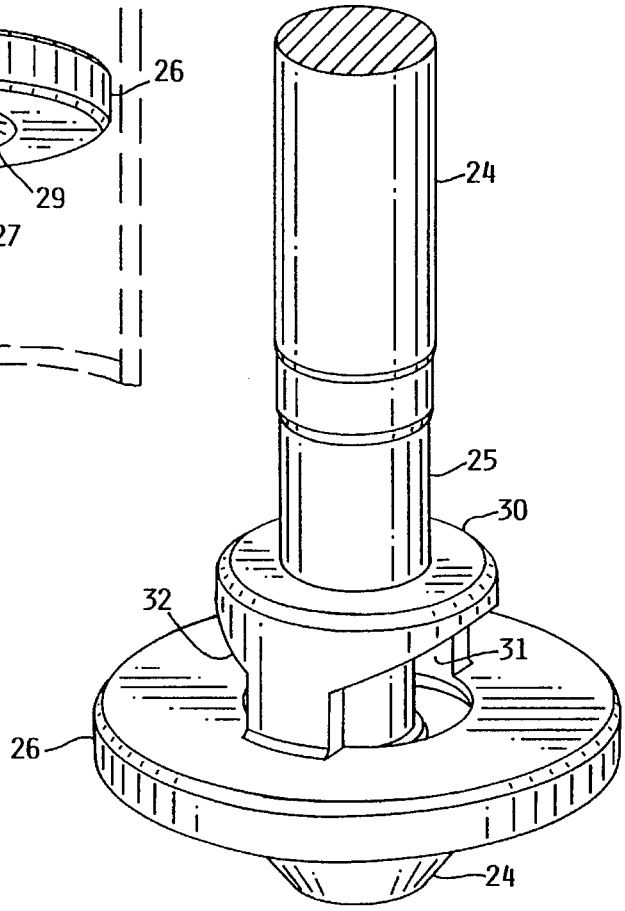
FIG. 3 shows a further isometric view of the priming piston and valve.

FIG. 2 shows an elevational isometric view of the present invention. A priming valve element 27 is affixed to the lower end of priming piston rod 24, preferably by a threadable attachment. Priming valve 27 has a conical valve surface 28 which is complementary sized to mate against a beveled contoured surface 29 of priming piston 26. Priming piston 26 is affixed to a collar 30 which is slidably received about a reduced diameter portion 25 of priming piston rod 24. Collar 30 has a pair of openings 31, 32 cut therethrough, thereby exposing the priming piston rod 24. FIG. 3 shows a further isometric view illustrating the same components from another perspective. The openings 31, 32 provide a flow path from the lower surface 26*b* of piston 26 to the upper surface 26*a* of piston 26, whenever priming valve 27 is unseated from its engagement with beveled surface 29. Collar 30 is slidable upwardly over reduced diameter portion 25 until it contacts shoulder 33 which serves as a stop limiting further upward motion of collar 30 along priming piston rod 24. The lower slidable movement of collar 30 and priming piston 26 is limited by contact with surface 28 of priming valve 27.

Figure 4A:
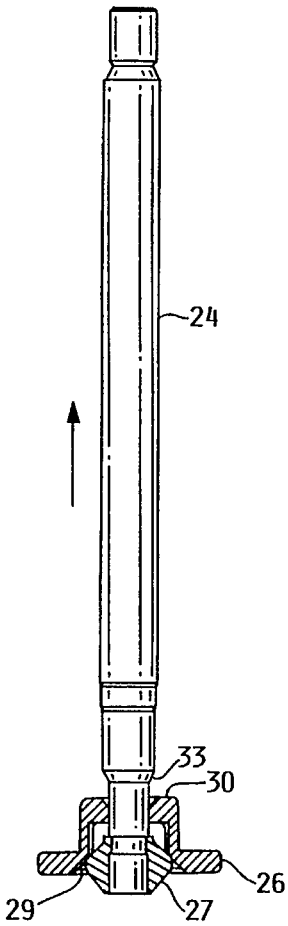
FIGS. 4A and 4B show an elevation view in mutually orthogonal cross-section views of the priming piston and valve in a first position.
Figure 5A:
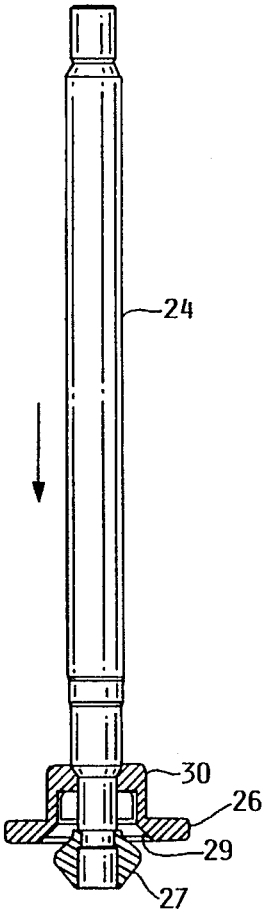
FIGS. 5A and 5B show an elevation view in mutually orthogonal cross-section views of the priming piston and valve in a second operating position.
Figure 4B:
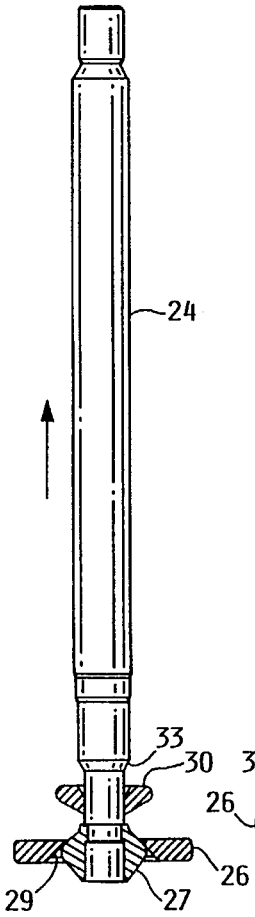
Figure 5B:
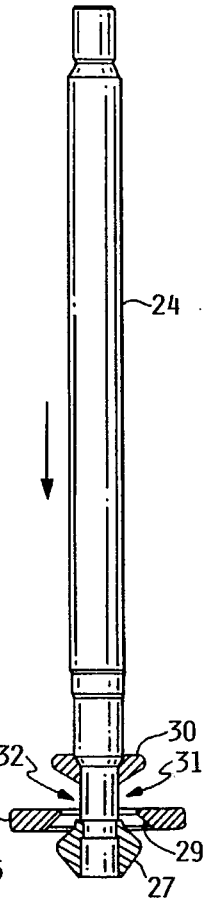

FIGS. 4A and 4B show mutually orthogonal elevation views of the present invention during the stroke when the priming piston rod 24 is moving upwardly. The priming valve 27 is seated against the contoured surface 29 of priming piston 26. Therefore, the flow path through priming piston 26 is blocked and any liquid which is confined within priming cylinder 18 will be forced upwardly in cylinder 17 into the intake valve housing 16. FIGS. 5A and 5B show mutually orthogonal elevation views of the invention during the stroke portion when priming piston rod 24 is moving downwardly. In this case, priming piston 26 separates from contact with priming valve 27 and moves relatively upwardly until collar 30 engages against shoulder 33. Therefore, a liquid flow path through priming piston 26 exists between priming valve 27 and the center opening of priming piston 26. This flow path includes the pair of openings 31, 32 in collar 30. As a result, liquid may pass from the region below priming piston 26 into the region above priming piston 26 via the aforesaid flow path.

On the upstroke, liquid is drawn into the priming cylinder and forced through the center of the intake seat, into the intake valve housing 16 by the priming piston 26. At the same time, liquid is being delivered above the piston valve assembly 22 and out of pumping cylinder 14 via pump outlet 13. At the top changeover point in the pump stroke, the piston rod 20 begins to move downwardly, thereby opening the piston valve assembly 22 and moving the priming piston rod 24 downwardly. The frictional contact between the priming piston rod 24 and the intake valve 15 causes the intake valve 15 to move downwardly until it seats on the intake valve seat; thereafter, the priming piston rod 24 continues to move downwardly, sliding through the intake valve 15. During the downstroke, liquid is delivered above the closed intake valve 15, through the piston valve assembly 22, upwardly into the pumping cylinder 14 and out of the pump outlet 13. At the same time, the priming piston 26 is moving downwardly and out of the priming cylinder 18 to allow liquid for the next complete pump cycle to be loaded into the priming cylinder 18. Before the priming piston 26 moves completely out of the priming cylinder 18, fluid is passing through the opened priming piston valve, charging the priming cylinder above the priming piston. At the bottom changeover point, the intake valve 15 remains stationary with rod 24 due to its frictional contact with rod 24. The piston rod 20 moves upwardly, closing the piston valve assembly 22 and moving the assembly toward the top of the cylinder 14. The priming valve 27 contacts priming piston 26 and travels upwardly with the priming piston rod 24, again moving liquid upwardly through the priming cylinder 18, into intake valve housing 16.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. In a reciprocable liquid pump having a piston rod and piston adapted for connection to a driving source, and a piston valve assembly in the piston and reciprocably movable along an axis within a main pumping cylinder, and an intake valve housing having an intake valve and intake valve seat, connected to the main pumping cylinder, the improvement comprising:

a) a priming cylinder connected to said intake valve housing in alignment with said axis;

b) a priming piston rod having a first end connected to said piston valve assembly in alignment with said axis, and having a second end;

c) a priming valve element affixed to said second end; and d) a priming piston slidably movable along said priming piston rod and having a central opening and valve seat engageable against said priming valve element.

2. The apparatus of claim 1, wherein said priming valve further comprises a conical valve surface.

3. The apparatus of claim 2, wherein said priming piston valve seat comprises a beveled surface complementary sized to sealably engage against said priming valve conical valve surface.

4. The apparatus of claim 3, wherein said priming piston rod comprises a circular cross section having a reduced diameter lower portion, thereby forming a shoulder at the edge of said reduced diameter lower portion.

5. The apparatus of claim 4, wherein said priming piston further comprises a collar slidably fitted about said reduced diameter lower portion.

6. The apparatus of claim 5, wherein said collar comprises at least one opening for providing a flow path through said collar.

7. The apparatus of claim 6, wherein said primary piston rod has a length sufficiently long so as to move said priming piston outside said priming cylinder during at least a portion of the stroke of the reciprocable pump.

8. A reciprocable liquid pump having a piston rod adapted for connection to a driving source, comprising:

a) a pump piston valve connected to said piston rod and a main pumping cylinder aligned along a common axis with said piston rod, the pump piston valve being reciprocably movable within said main pumping cylinder;

b) a priming cylinder connected to said main pumping cylinder and aligned along said axis;

c) a priming piston rod connected to said piston valve and aligned along said axis, said priming piston rod having a lower end positioned along said axis;

d) a priming valve member affixed to the lower end of said priming piston rod; and e) a priming piston slidably movable about said priming piston rod, said priming piston having a central opening and seat engageable by said priming valve member.

9. The apparatus of claim 8, wherein said priming piston rod further comprises a circular cross section and a reduced diameter lower portion, and said priming piston is slidably movable over said reduced diameter lower portion.

10. The apparatus of claim 9, wherein said priming valve member further comprises a conical surface facing toward said priming piston.

11. The apparatus of claim 10, wherein said priming piston seat comprises a beveled surface complementary sized to engage said priming valve member conical surface.

12. The apparatus of claim 11, wherein said priming piston further comprises a collar slidably fitted over said reduced diameter portion of said priming piston rod.

13. The apparatus of claim 12, wherein said collar comprises at least one opening providing a flow path therethrough.

* * * * *